US005894290A

United States Patent [19]

Oona et al.

[11] Patent Number: 5,894,290

[45] Date of Patent: Apr. 13, 1999

[54] PARABOLIC ROD ANTENNA

[75] Inventors: Hillar Oona, Ganesvoort; Seymour Saslow, Saratoga; Arthur R. Schrum, Johnstown, all of N.Y.

[73] Assignee: Espey Mfg. & Electronics Corp., Saratoga Springs, N.Y.

[21] Appl. No.: 08/727,697

[22] Filed: Oct. 9, 1996

[51] Int. Cl.[6] ..... H01Q 15/14; H01Q 19/12

[52] U.S. Cl. ..... 343/840; 343/916; 343/912

[58] Field of Search ..... 343/840, 915, 343/916, 912; H01Q 15/14, 15/16, 19/12

[56] References Cited

U.S. PATENT DOCUMENTS

| | | | |
|---|---|---|---|
| D. 269,009 | 5/1983 | Mann et al. | D14/3 |
| D. 275,100 | 8/1984 | Mann et al. | D14/86 |
| D. 275,197 | 8/1984 | Feagle | D14/86 |
| 741,622 | 10/1903 | Brown | 343/840 |
| 2,423,648 | 7/1947 | Hansell | 343/916 |
| 2,530,098 | 11/1950 | Van Atta | 343/912 |
| 2,703,842 | 3/1955 | Lewis | 343/912 |
| 2,850,735 | 9/1958 | Harris | 343/840 |
| 3,178,713 | 4/1965 | Yangs | 343/840 |
| 3,445,854 | 5/1969 | Callaghan | 343/912 |
| 4,160,980 | 7/1979 | Murray | 343/795 |
| 4,405,928 | 9/1983 | Elsbernd | 343/912 |
| 4,647,943 | 3/1987 | Metcalfe | 343/916 |
| 4,710,777 | 12/1987 | Halverson | 343/840 |
| 4,801,946 | 1/1989 | Matz, Jr. | 343/840 |
| 4,860,022 | 8/1989 | DoBroski | 343/840 |
| 5,291,212 | 3/1994 | Cox | 343/840 |

OTHER PUBLICATIONS

Andrew Gridpar Antennas Brochure, pp. 1–8, Bulletin R1–20–30 (Apr. 1994), Andrew Corp., Il, USA.

*Primary Examiner*—Hoanganh Le

*Attorney, Agent, or Firm*—Weingram & Associates, P.C.

[57] ABSTRACT

A grid-type microwave antenna, easy to manufacture, assemble and disassemble, is formed of a number of spaced reflector rods which, when mounted in a frame, form a parabolic reflecting surface. The frame includes U-shaped channels for mounting and supporting the spaced reflector rods. Each of the rods has a curvature so that the combination of the rods spanning the frame forms a parabolic reflector. The frame is formed by channels having holes to receive the central and the end portions of the reflector rods. Insulating sleeves are provided for the central portion of each rod. Insulating cups are used for the end portions of each rod.

12 Claims, 3 Drawing Sheets

PARABOLIC ROD ANTENNA

FIELD OF THE INVENTION

The present invention relates to a grid-type microwave antenna which is easy to manufacture, assemble and disassemble because it is formed of a number of spaced reflector rods which, when mounted in a frame, form a parabolic reflecting surface.

BACKGROUND OF THE INVENTION

Grid-type microwave antennas are known in the prior art. When compared to antennas whose reflecting surfaces are formed of solid metal, the grid-antennas offer the advantages of low wind load, light weight, and can be shipped disassembled, then assembled on site. Grid antennas are shown in several prior art patents.

U.S. Pat. No. 2,850,735 to Harris discloses a parabolic antenna structure including a circular rim to which hollow tubular members of aluminum alloy are welded or otherwise fastened together.

U.S. Pat. No. 3,178,713 to Yang discloses a parabolic antenna consisting of two triangular sections and spaced parallel rods bent in planes which are parallel with each other to form a reflecting surface of a paraboloid of revolution. The spacing of the rods is gradually increased with the distance from the center-line of the reflector.

U.S. Pat. No. 3,445,854 to Callaghan discloses an antenna consisting of a hollow, rectangular, elongated support structure with holes at a top surface and holes at a bottom surface in line with those at the top surface, respectively. The dimensions of the support structure restrict the access to the interior of the structure. Collars surrounding the holes are fabricated at the interior or exterior of the holes at both the top and bottom sides. A U-shaped member formed with beads or die surfaces therealong is inserted at an interior or exterior of the support structure to coact with the collars to lock the rods in place extending through the holes.

U.S. Pat. No. 4,160,980 to Murray discloses a dipole antenna with parabolic reflector which includes a circular horizontal rim to which a plurality of spokes are riveted. The rim can be formed from a pair of semi-circular rim sections or from a single unitary metal strip.

U.S. Pat. No. 4,405,928 to Elsbernd discloses a wind load reduction in tower mounted broadcast antennas consisting of reflectors as horizontal members and vertical members interconnected by inserting the members through each other and then welding the members or fastening them by screws, bolts etc.

U.S. Pat. No. 4,647,943 to Metcalfe discloses a mesh dish antenna and hub consisting of a plurality of curved ribs radially extending from a central hub to a rim where the curved ribs are secured with screws.

U.S. Pat. No. 4,710,777 to Halverson discloses a dish antenna structure which consists of radially extending ribs connected at their outer ends to a circular, peripheral ring by nuts and bolts. The ring is preferably formed with a peripheral ring groove facing the center of the antenna, which groove receives and holds the outer edges of antenna panels supported by the ribs.

U.S. Pat. No. 4,801,946 to Matz, Jr. discloses a grid antenna consisting of a plurality of spaced metallic reflector ribs having an elongated cross-sectional configuration that is in the direction generally parallel to the axis of the feed. The ends of the ribs are connected to a hoop.

U.S. Pat. No. 5,291,212, to Cox discloses a grid-type paraboloid microwave antenna consisting of a rigid rim surrounding an array of parallel conductive rods. The rim forms a U-shaped channel along which a pair of opposed channels extend to receive an insulating strip to cover entry to the channel. The strip includes a series of spaced holes to admit ends of the rods into the channel. A second insulating strip in contained in a second pair of channels along the bottom of the U-shaped channel to prevent the ends of the rods from making electrical contact with the bottom of the channel. The insulating strip holds the ends of the rods in the desired positions relative to each other. The holes in the insulating strip gradually change from circular to increasingly elongated slots having radiused ends to accommodate the changing angle of intersection between the arches of the rods and the strip around the circumference of the rim.

U.S. Pat. No. Des. 275,197 to Feagle discloses a design for a portable antenna ground scoring unit for air to ground gunnery which appears to include a plurality of parallel arranged ribs or rods mounted to a supporting frame work.

SUMMARY OF THE INVENTION

The present invention consists of a U-shaped frame formed with an octagonal periphery across which a plurality of reflector rods are mounted. Each one of the rods has a slightly bent contour so that the combination of the rods spanning the frame forms a parabolic reflector.

The U-shaped frame is formed with a channel extending along its length and in communication with the exterior of the frame. An upstanding arm of the U-shaped frame closest to a hub of the antenna is constructed with a plurality of discrete holes therethrough in communication with the channel. Each of the holes is formed through the arm at an angle to receive an end portion of a corresponding one of the reflector rods. The construction and arrangement of each hole in the upstanding arm of the frame prevents the end of the corresponding rod in the hole from contacting the upstanding arm of the frame at the opposed side of the channel.

The frame can be constructed of a plurality of sections detachably connected with each other. Shaping members intersect at the hub and radiate to corresponding quadrants of the frame periphery.

The present invention includes a U-shaped frame constructed with a plurality of discrete, individual holes each of which is arranged in the frame to receive an end portion of a corresponding one of the conductive rods of the antenna.

The holes of the U-shaped frame are formed with an interior wall angled to receive a correspondingly angled portion of the conductive rod.

Each of the rods are insulated from the supporting frame and from each other with nylon bushings for the ends of each rod and a nylon bushing surrounding each rod at its center.

A principal object and advantage of the invention is the provision of a grid-type microwave antenna formed of a plurality of pre-shaped conductive rods. Another object and advantage of the invention is the provision of a grid-type antenna which is easily assembled in the field. A still further object and advantage of the invention is the provision of an antenna which can be shipped to a field location in pieces and assembled on site. A still further object and advantage of the invention is the provision of an antenna which insulates the conductive rods of a grid-type antenna from its frame and from each other with insulating end cups. A still further object and advantage of the invention is the provision of an antenna where the central portions of the conductive rods are insulated from a supporting frame and from each other by insulating sleeves.

BRIEF DESCRIPTION OF THE DRAWINGS

The foregoing, and other objects, features and advantages of the invention will be apparent from the following description of the preferred embodiment of the invention as illustrated in the accompanying figures of the drawings. There are shown in the figures of the drawings embodiments which are present preferred. It should be understood that the invention is not limited to the precise arrangement and instrumentality shown in the drawings, of which.

Figure 1:
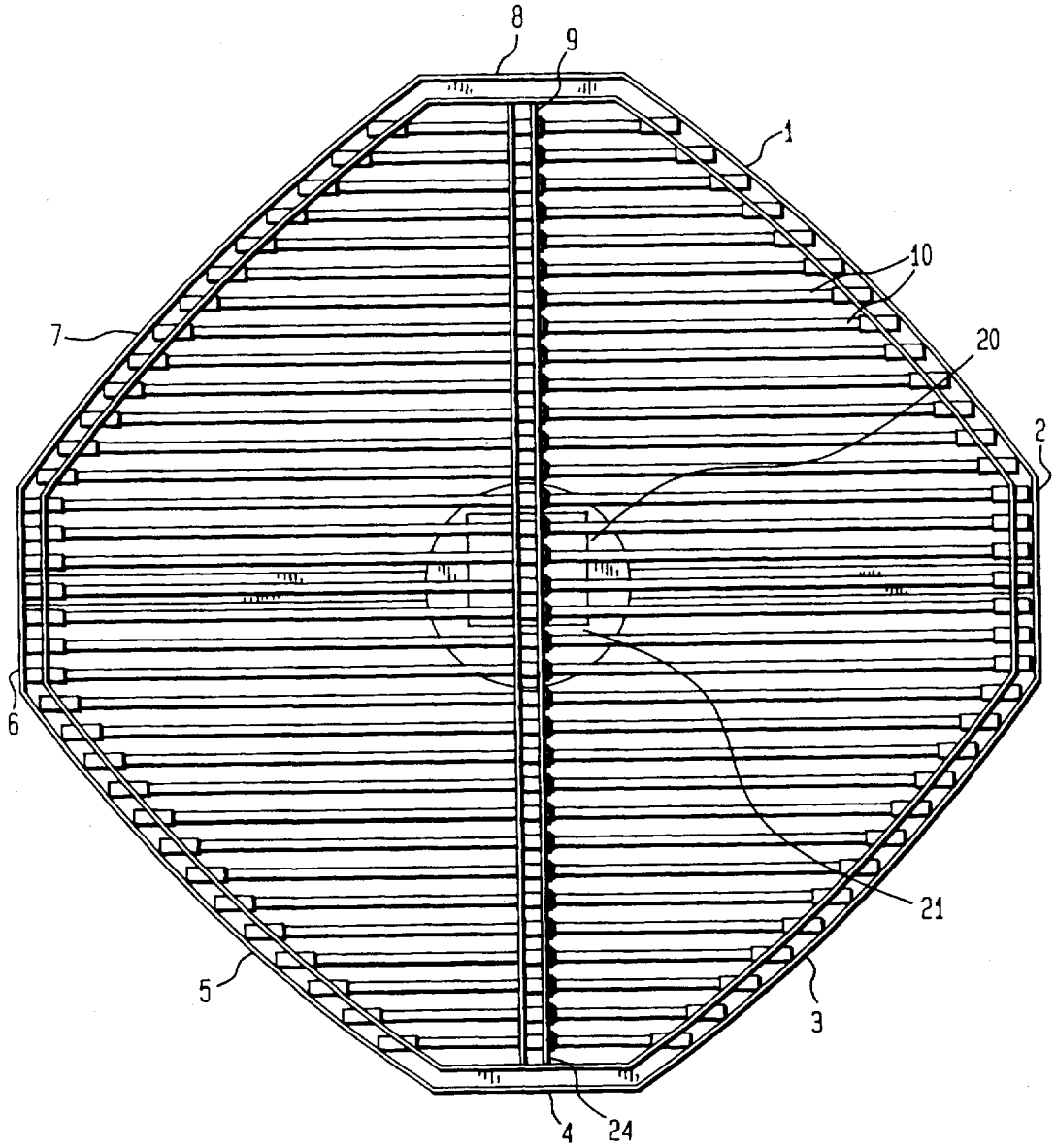
FIG. 1 is a back view of the frame of the parabolic antenna of the invention.

Generally, with reference to FIGS. 1–4, the parabolic antenna of the present invention includes a plurality of rods 10 which are mounted in a frame in the U shaped channel supports 1–3, 5–7 and 9 of FIG. 1. The remaining portions of the frame, 4 and 8, 15 and 17, do not receive or support any of the rods 10. Frame portion 4 connects the ends of portions 3 and 5. Frame portion 8 connects the ends of portions 1 and 7.

Figure 4:
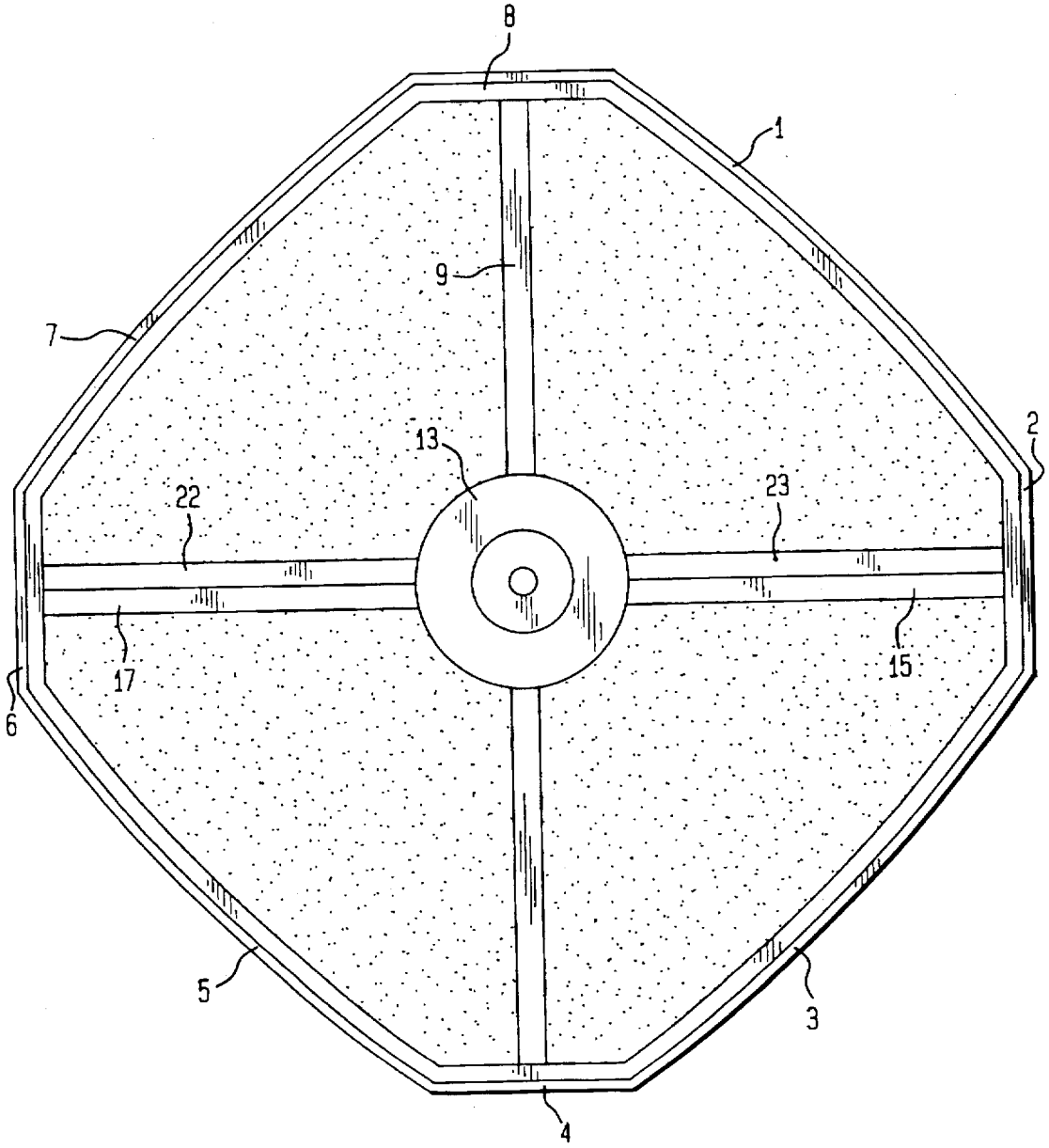
FIG. 4 is a front view of the antenna of FIG. 1.

As shown in FIG. 4, each antenna half has a central hub 20 or 21, from which extends metallic braces 15 and 17 or 22 and 23. The antenna is thus mechanically divided into quadrants. For example, one quadrant is formed by brace 15, and frame portions 2, 3 and 4. Another quadrant is formed by brace portion 17 and frame portions 4, 5, and 6. Another quadrant is formed by brace 22 and portions 6, 7, and 8. Another quadrant is formed by brace 23 and portions 8, 1 and 2.

Figure 2:
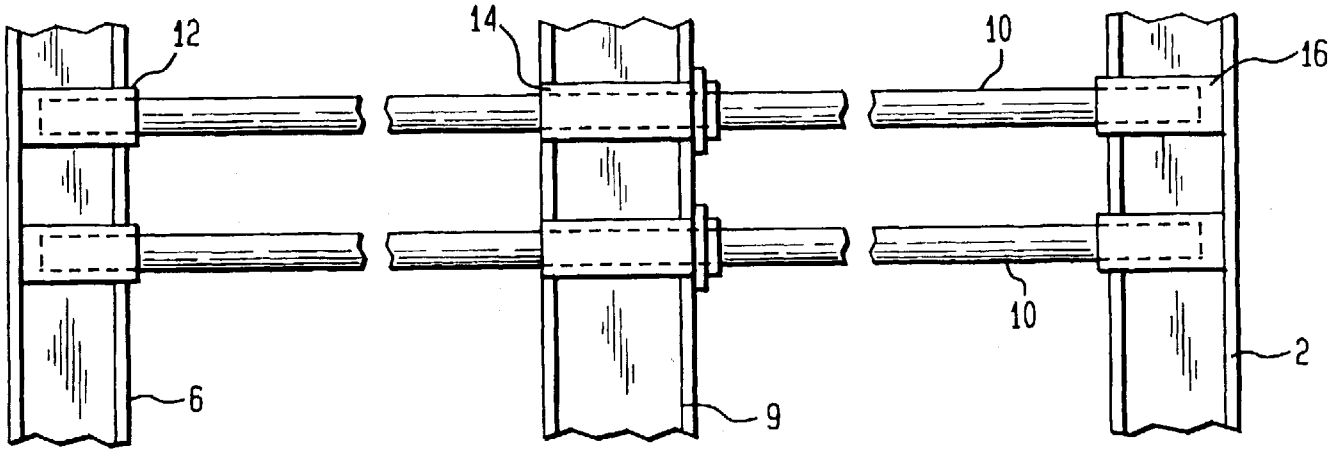
FIG. 2 is a back view of enlarged portions of the frame of FIG. 1.
Figure 3:
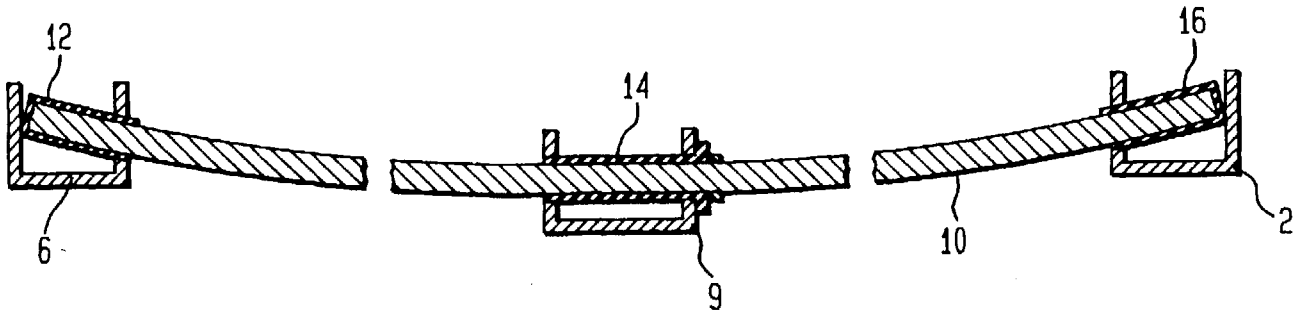
FIG. 3 is a top sectional view of a portion of the frame of FIG. 2.

Each of the rods are insulated from each other and from the frame supports via nylon bushings 12, 14 and 16 of FIG. 3. Each of support 9 and 24 of FIGS. 1–3 contain a plurality of pairs of through holes for receiving rods 10 and insulating bushing 14 therein. Each of the rod receiving supports of FIG. 1, 1–3 and 5–7 contain a single through hole in the interior wall of the channel support for receiving a portion of rods 10 and insulating bushings 12, 16, therein.

More specifically, as shown in FIGS. 1–3, the frame for the parabolic antenna includes U-shaped channel supports, 1, 2, 3, 5, 6 and 7 for the ends of the rods 10, and support 9 and 24 for the center of each of the rods 10. Each of the supports 1, 2, 3, 5, 6 and 7 is a U-shaped channel having an aperture in the interior wall thereof for receiving the ends of each of the rods 10 therein. The support 9 and 24 is a U-shaped channel having a pair of apertures axially disposed in each wall of the channel for receiving the central portion of the rods 10 therein.

As shown in detail in FIG. 2, the rods 10 are insulated from the frame and from each other via nylon end cap bushings 12 and 16. These bushings are designed to fit over the ends of each rod and also to fit into the aperture in the interior wall of the U-shaped channel. The end cap bushings 12 and 16 are of sufficient length so as to engage the outer wall of the channel and thus support and hold each of the rods 10 in the U-shaped trough of the frame between the two walls of the channel.

Significantly, the parabolic shape of the grid array is achieved by shaping or angling each of the rods 10 to its required parabolic configuration and inserting that rod in the position in central support 9 and 24.

Each of the rods 10 are fit in a pair of holes in the support 9 and 24. The holes in the single wall for the ends of the rods 10 in the frame supports 1–3 and 5–7 are shaped or angled to receive a correspondingly shaped or angled end portion of a rod 10.

While the invention has been described in its preferred embodiment, it is to be understood that the words which have been used are words of description rather than limitation and that changes may be made within the purview of the appended claims without departing from the true scope and spirit of the invention in its broader aspects.

We claim:

1. In a grid-type antenna, the improvement comprising:

a plurality of conductive rods positioned parallel to each other in spaced apart relationship to each other, each of said rods being curved along its length to form a section of a paraboloid so that, when all the rods are positioned parallel to each other in spaced apart relationship to each other, they form a paraboloidal reflector; and a rim iincluding:

a plurality of U-shaped channels forming a frame, a further U-shaped channel centrally mounted in said frame for receiving and supporting each of said rods therein, end cups for receiving the ends of each of said rods and electrically insulating each of said rods from said rim and from each other, and at least one aperture in one wall of said rim for receiving said end cups and the ends of each of said rods.

2. The grid-type antenna of claim 1 wherein said further U-shaped channel has at least two apertures in opposing walls thereof for receiving the central portion of each of said rods therein.

3. The grid-type antenna of claim 2 wherein said central portion of each of the rods is insulated from said further U-shaped channel and from each other.

4. The grid-type antenna of claim 3 wherein the insulation of said central portion of said rods includes insulating sleeve means for covering said central portions of said rods.

5. The grid-type antenna of claim 4 wherein said insulating sleeve means is mounted in said apertures in said further U-shaped channel.

6. The grid type antenna of claim 2 wherein each of said apertures for receiving said end cups is shaped in accordance with the curvature of the rod to be received in said aperture.

7. A grid-type antenna comprising a plurality of curved rods, a frame for mounting said rods, said frame including first U-shaped channel means for receiving and supporting a central portion of each of said rods, and second and third U-shaped channel means for receiving and supporting the ends of each of said rods, each of said rods including insulating sleeve means for insulating the central portions of said rods from said first U-shaped channel means and insulating cup means for insulating the ends of said rods from said second and third U-shaped channel means.

8. The grid-type antenna of claim 7 further including opposed apertures in said first U-shaped channel means for receiving said central portions of each of said rods.

9. The grid-type antenna of claim 8 further including an aperture in said second and third U-shaped channel means for receiving said ends of each of said rods.

10. The grid-type antenna of claim 9 wherein said insulating sleeve means is connected between said opposed apertures and said central portions.

11. The grid-type antenna of claim 9 wherein said insulating cup means is connected between said aperture in said second and third U-shaped channel means and the ends of said rods.

12. The grid-type antenna of claim 9 wherein each of said rods are curved and each of said apertures which receives said end cup means are formed having a curvature to match the curvature of a given rod so that only the said given rod may be properly inserted in said apertures.

* * * * *